US006012947A

United States Patent [19]

Zann et al.

[11] Patent Number: 6,012,947

[45] Date of Patent: Jan. 11, 2000

[54] CONNECTOR WITH SEMI-AUTOMATIC COUPLING ACCOMPANYING A MECHANICAL COUPLING

[75] Inventors: Olivier Zann, Wackenbach; Henri Ullius, Schwindratzheim, both of France; Jose Ramon Sanz Pinedo; Luis Gras Tous, both of Madrid, Spain

[73] Assignee: Eaton Corporation, Cleveland, Ohio

[21] Appl. No.: 09/069,130

[22] Filed: Apr. 29, 1998

[51] Int. Cl.[7] ..... H01R 13/73

[52] U.S. Cl. ..... 439/557; 439/15

[58] Field of Search ..... 439/557, 15, 13, 439/34, 163, 164, 162, 552, 544, 527; 280/728.2, 731

[56] References Cited

U.S. PATENT DOCUMENTS

| | | | |
|---|---|---|---|
| 4,157,854 | 6/1979 | Beauch | 439/15 |
| 5,575,676 | 11/1996 | Tsukakoshi et al. | 439/347 |
| 5,721,408 | 2/1998 | Yokota et al. | 200/61.54 |
| 5,741,145 | 4/1998 | Kikkawa et al. | 439/164 |
| 5,752,843 | 5/1998 | Kawamoto et al. | 439/164 |
| 5,769,649 | 6/1998 | Welschholz et al. | 439/164 |
| 5,800,191 | 9/1998 | Honda et al. | 439/164 |
| 5,800,208 | 9/1998 | Ishizuka et al. | 439/557 |
| 5,884,936 | 3/1999 | Matsu et al. | 280/728.2 |

*Primary Examiner*—Paula Bradley
*Assistant Examiner*—Ross Gushi
*Attorney, Agent, or Firm*—Roger A. Johnston

[57] ABSTRACT

A system for fixing one of two plugs (3, 4) of an electrical connector to a mechanical device (1), the one plug (4) being designed to be connected thereto in a detachable manner, the other plug (3) being attached to an assembly (2) to which the device (1) has just been coupled mechanically along an axis parallel to the axis of the electrical coupling, characterized in that it includes means for assembling/disassembling the plug (4) to and from the said mechanical device (1), the assembly/disassembly being carried out parallel to the coupling axes, assembly being made simply by clipping, while disassembly is carried out simply by pulling.

10 Claims, 10 Drawing Sheets

CONNECTOR WITH SEMI-AUTOMATIC COUPLING ACCOMPANYING A MECHANICAL COUPLING

BACKGROUND OF THE INVENTION

The present invention concerns in a general manner the steering wheels and the tops of steering columns of motor vehicles. More precisely, it concerns the problem of assembling steering wheels onto the tops of steering columns.

The new generation of steering wheels permits the assembly to be carried out blind, with the mechanical connecting system between the steering wheel and the top of the steering column being for example of the clipped type. Thus the assembly can be performed without tools, and at a high rate. However, assembling a steering wheel onto the top of a column requires two distinct types of connections: a mechanical connection, only concerned with the previous comment, and an electrical connection, the importance of which increases with time.

The problem addressed by the invention concerns the electrical junction: it is not possible to provide a connector with a plug simply attached to the top of the column and a plug simply attached to the steering wheel, while providing that the mechanical assembly simultaneously brings about the electrical connection. The electrical connection must be kept free from any mechanical stress liable to bring about micro-breaks, in particular on account of the existence of an air bag in the steering wheel.

The steering wheel is subject to mechanical stresses (axial play, eccentricity creating radial stresses, etc.) which thus prevent the aforementioned solution from being applied. The connector to be provided must be able to accommodate tolerances in positioning the steering wheel as well as its eccentricity. In addition, no other mechanical stress should exist, so as to guarantee electrical continuity.

BRIEF SUMMARY OF THE INVENTION

The solution proposed by the invention provides for the mechanical connection between the steering wheel and the part of the connector which is fixed thereto to become disconnected once the electrical connection is made. The plug is thus held in the steering wheel by means of a floating mechanical system which, when it frees the said plug mechanically, also frees it from any stress.

The invention concerns a system for fixing one of the plugs of an electrical connector to a mechanical device, the plug being designed so as to be connected thereto in a detachable manner, the other plug being attached to an assembly to which the device is mechanically coupled along an axis parallel to the axis of the electrical coupling, the system being characterized in that it includes means for assembling/disassembling the plug to and from the mechanical device, the assembly/disassembly being carried out parallel to the coupling axes, assembly being made simply by clipping, while disassembly is carried out simply by pulling.

The plug connected to the mechanical device, for example a steering wheel, can be fixed thereto in such a way that an axial force in one direction or another enables it to be freed or attached.

More precisely, the plug connected to the said mechanical device has two flexible lugs each possessing a protuberance acting as a cam, each of the said cams being directed at 180° to each other, the flexible lugs cooperating with at least one orifice made in the mechanical device, so that when the plug is clipped in, the cams rest on a surface opposite to the side of the mechanical device facing the assembly having the fixed plug.

The lugs are preferably identical, the cams being located at their end away from the connecting interface.

Preferably, the cams have a plane of symmetry perpendicular to the axis of the plug parallel to the coupling axes.

According to one possible configuration, they have, outwards, the form of a V with a plane base.

These flexible lugs are not however sufficient to ensure correctly the fixing of the plug to the mechanical device to which it is connected.

This has in addition at least one elastic return component acting parallel to the coupling axes, and resting in at least one place on the plug and on the side of the said mechanical device facing the assembly having the fixed plug, the elastic component exerting equal and opposite actions on each of these.

The fixing is completed by these return components which exert an action on the mechanical device which opposes that of the flexible lugs. These two contrary actions ensure attachment and their elastic properties enable detachability to be ensured and the repetition of movement in both directions.

According to one possible configuration, the plug connected to the mechanical device has a box with a parallelepiped appearance, the flexible lugs being disposed in the region of the small faces; whereas, the large faces have supporting edges for the elastic components.

The mechanical device which receives the plug, preferably a steering wheel, includes an orifice made in a wall substantially perpendicular to the coupling axis, provided with notches which can receive the flexible lugs, the surface of the notches positioned opposite to that facing the plug being adapted to house the cams of the flexible lugs.

The plug connected to the mechanical device is thus clipped with the aid of lateral lugs provided with cams inserted, by virtue of their flexibility, in an orifice with a corresponding shape made in the mechanical device, connection being maintained by the action of the elastic components of the other side of the wall in which the orifice is made.

The elastic return components are attached to wings projecting perpendicularly beyond the large faces of the box and which are, in operation, parallel to the wall having the orifice, and rest on the said wall in the vicinity of the orifice.

These elastic components may for example be metal blades having a form in accordance with the aforementioned spatial configuration.

They may also be coil springs disposed, when the plug is clipped into the mechanical device, parallel to the axes of connection.

Finally, the elements may be parts made of synthetic material of the foam type having elastic properties, enabling them to exert a return action.

According to a possible configuration, these parts may be pads made of foam, the surface of which facing the said wings is self adhesive.

In order to optimize the invention such as has been presented above, it has been provided that the electrical connector, one of the plugs of which is attached to an assembly of the steering column and the other plug of which is fixed in a detachable manner to a mechanical device of the steering wheel, is provided with a mechanical system performing a relative axial movement between the plugs.

Preferably, it consists of a locking connector, one of the plugs of which has a locking device enabling the electrical connection to be made when the connector begins to be mechanically coupled and, by an inverse movement, enabling the electrical connection to be undone so as to bring it to its position at the start of coupling.

Preferably, the said connector has a locking device having the form of a transverse stirrup sliding laterally in one of the plugs.

The mechanical device receiving one of the plugs may receive either the one plug or the other plug. According to the most usual configuration, it is the internal or receptacle electrical connector which is provided with the detachable attachment system of the invention, which however does not include the transverse stirrup.

This invention is therefore, applicable to a steering wheel of a vehicle to be coupled to the top of a column, the mechanical connection and the electrical connection having parallel axes.

Within the context of the invention, the completion of electrical connection is made subsequently, for example by locking the two plugs when it is in the connected position.

The invention is however limited to the system for detachably fixing a plug to a steering wheel, but it also concerns a steering wheel fitted with a plug according to the aforementioned procedures.

The invention also concerns an assembly comprising a steering wheel of a motor vehicle and the top of a steering column on which is attached a connecting plug designed to cooperate with the corresponding plug of the steering wheel, characterized in that, when the steering wheel is assembled mechanically on the top of the column, the mechanical connection of the electrical connecting plugs is also commenced.

In addition, the invention concerns a method for assembling a steering wheel of a motor vehicle onto the top of a steering column, provided with a fixed connecting plug designed to cooperate with the plug of the steering wheel, including the following steps:

- mechanical assembly of the steering wheel on the top of the column, commencing simultaneously to guide mechanically the electrical connection;
- mechanical detachment of the connector fitted to the steering wheel by completing the electrical connection.

Preferably, the mechanical detachment is carried out by the locking device of a locking electrical connector.

The invention concerns a method for detaching a steering wheel of a motor vehicle from the top of a steering column provided with a fixed connecting plug designed to cooperate with the plug of the steering wheel, comprising the following steps:

- disconnection of the electrical junction, resulting in the mechanical connection of one of the plugs to the steering wheel;
- mechanical detachment of the steering wheel from the top of the steering column.

The disconnection of the electrical junction is carried out by the locking device of a locking electrical connector.

The principal advantage of the present invention lies in that it permits a steering wheel to be assembled in the most rapid manner possible, without a tool, so that the production rate of motor vehicles fitted with this type of steering wheel is increased. This is naturally carried out while complying with the constraints associated with connections, which impose particular designs, as will now be described.

BRIEF DESCRIPTION OF THE DRAWINGS

This more detailed description will be made with reference to the accompanying figures, for which.

DETAILED DESCRIPTION OF THE INVENTION

Figure 1:
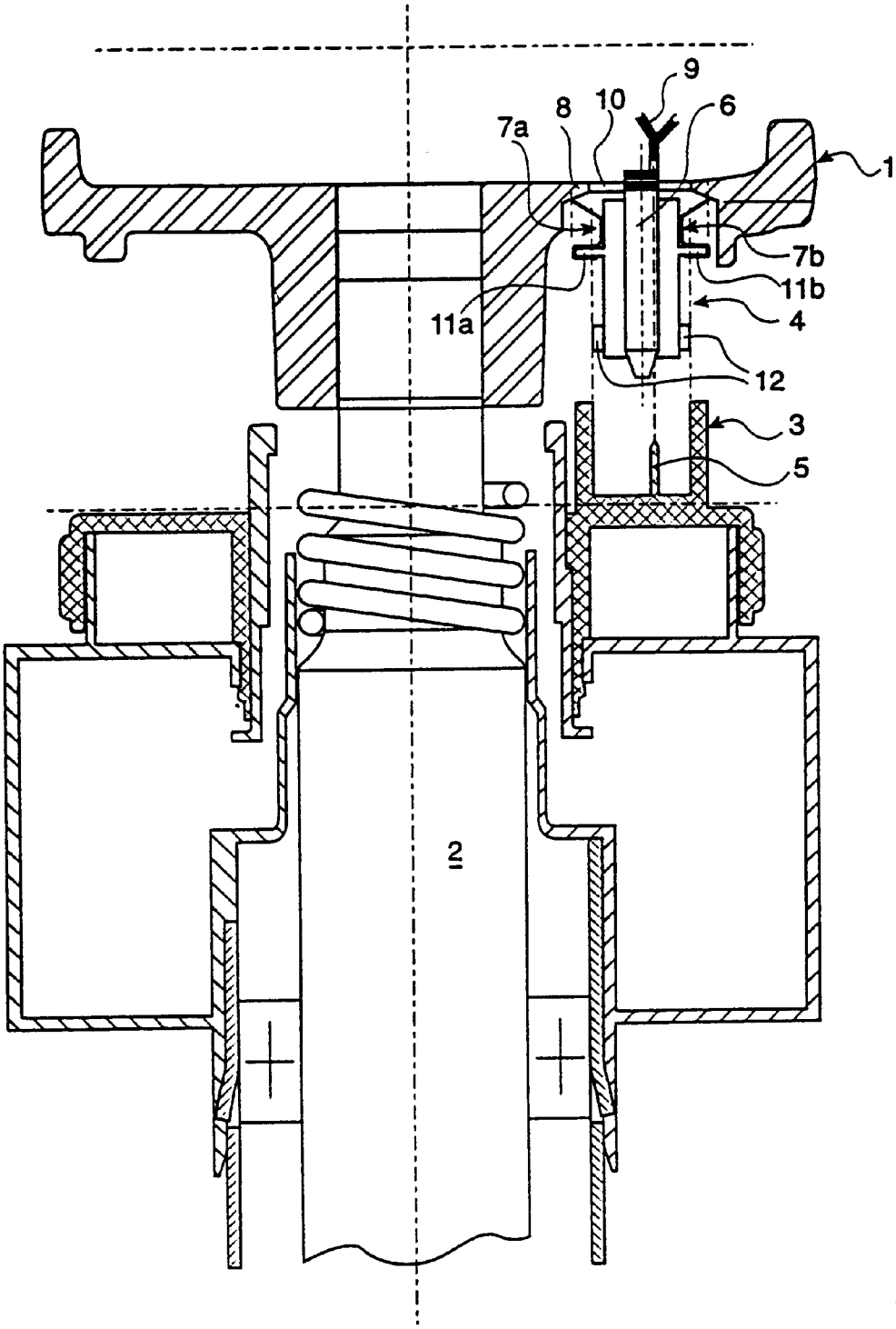
FIGS. 1 to 3 show in section the main steps in assembling a steering wheel provided with a plug of an electrical connector at the top of a steering column.
Figure 2:
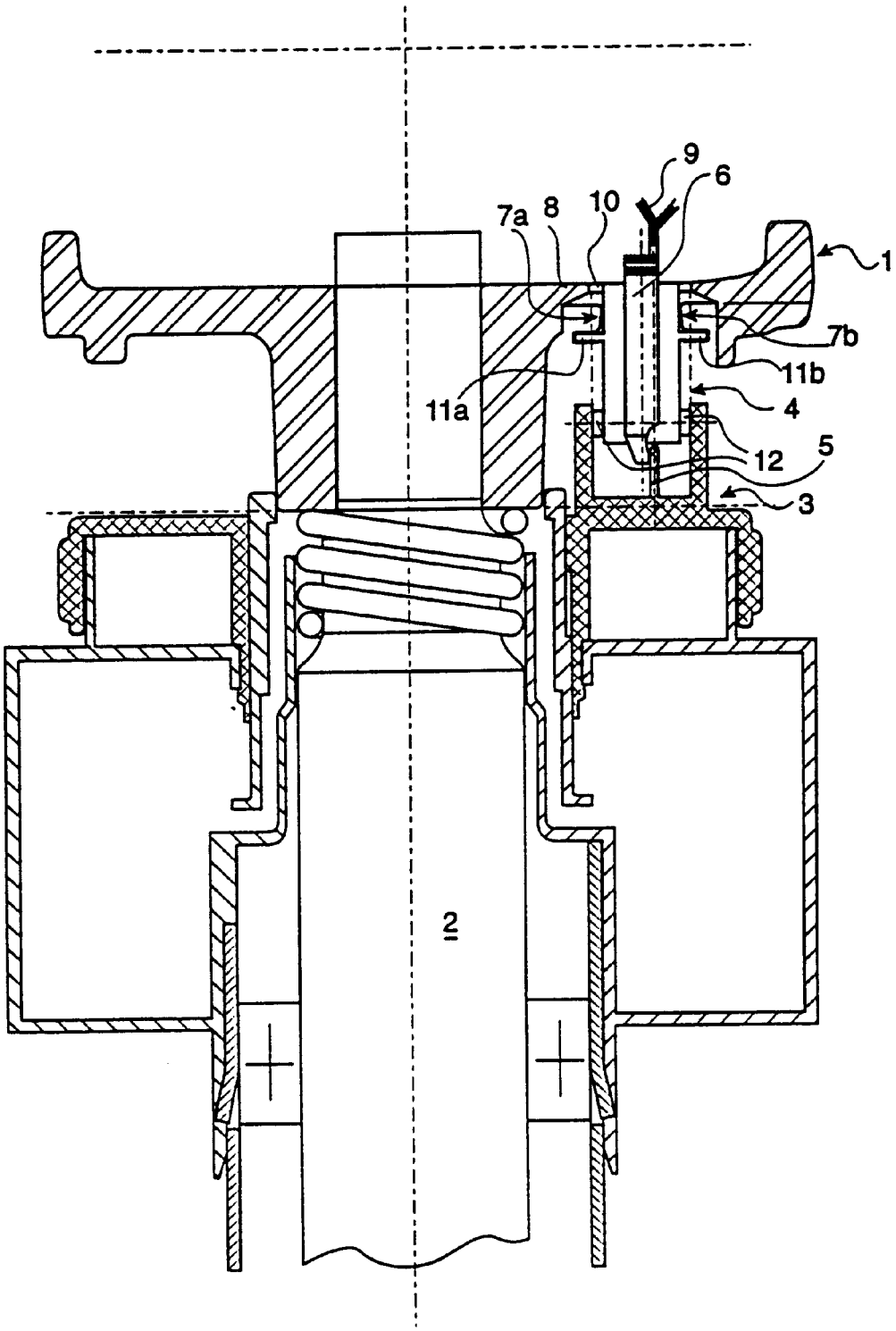
Figure 3:
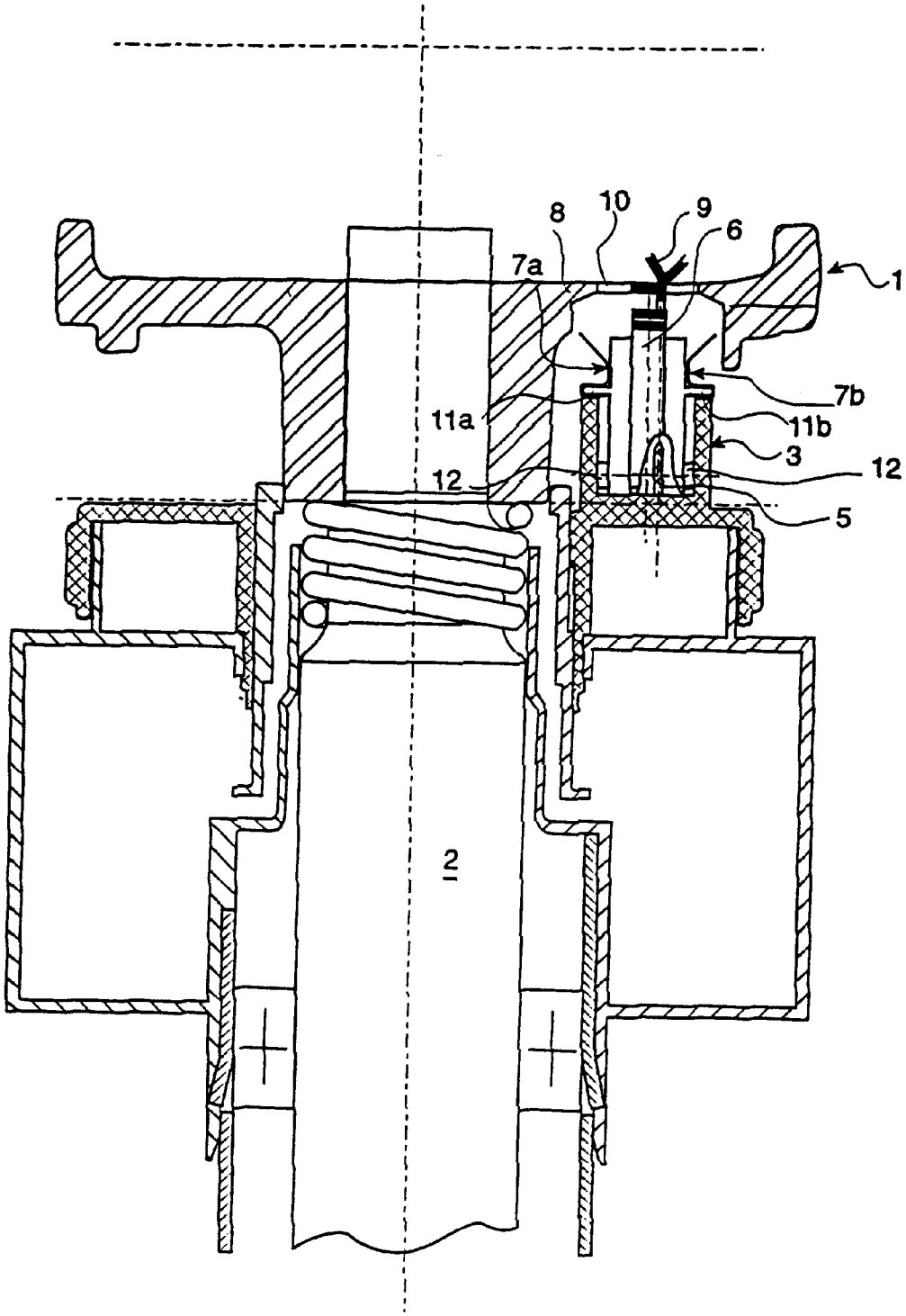

In FIGS. 1 to 3, the steering wheel 1 is shown in three different positions relative to the top of the steering column 2, the components of which are not distinguished hereinafter, since they do not form part of the invention. The reference 2 must therefore be understood to encompass generally the top of the column assembly.

The two plugs, 3 and 4, of the electrical connector are shown in the right hand part, in cross section, as well as the other components appearing in these figures. The connector 3 or plug 3 has connecting contacts 5 designed to be inserted in the corresponding orifices of the connector 4 or plug 4, fixed to the said steering wheel 1.

The electrical connector also includes a mechanical coupling, which will be returned to in detail hereinafter, and for which the connector 3 acts as a receiver, and the connector 4 acts as an insert, in a configuration parallel to that of the mechanical connection of the steering wheel onto the top of the steering column. There is not however any major ambiguity, and the roles could be substituted for each other without any problems occurring, the important thing being to define the components participating in the connections. The electrical components will hereinafter be designated by their type.

The component 4 is more complex than its homologue 3 and includes a detachable system for fixing it to the steering wheel 1 provided with:

flexible lugs 5; and elastic return components 7*a*, 7*b*.

which act either side of a wall 8 of the steering wheel 1 in which an orifice 10 is made enabling, in particular, the lugs 6 to pass as well as the wiring 9.

The plug 4 takes the form of a box having a substantially rectangular section, of which the large faces are provided with lateral wings 11*a*, 11*b* substantially parallel to the wall 8, and on which are attached elastic components 7*a*, 7*b*, which additionally rest on the said wall 8, as will be seen in greater detail hereinafter.

Finally, the large faces of the parallelepiped box of the connector 4 have studs 12 participating in the mechanical connection between the two plugs, in their relative movement and unlocking, as will be seen in greater detail hereinafter.

In FIG. 1, the steering wheel 1 and the plug 4 which is attached thereto are still at a distance from the top of the steering column 2 and from the plug 3 attached thereto.

In FIG. 2, mechanical assembly of the steering wheel 1 has been carried out, and the start of the mechanical connection is initiated for the plugs 3, 4 of the connector.

In this position, the plug 4 is still fixed to the steering wheel 1 whereas the connectors 3, 4 have commenced their mechanical connection.

In FIG. 3, mechanical attachment of the said plugs 3, 4 has been completed, i.e., the electrical junction has been completely made. The plug 4 is freed from the steering wheel 1, in a manner which will be seen hereinafter, and it is thus no longer subject to the mechanical stresses applied to the steering wheel.

Figure 4A:
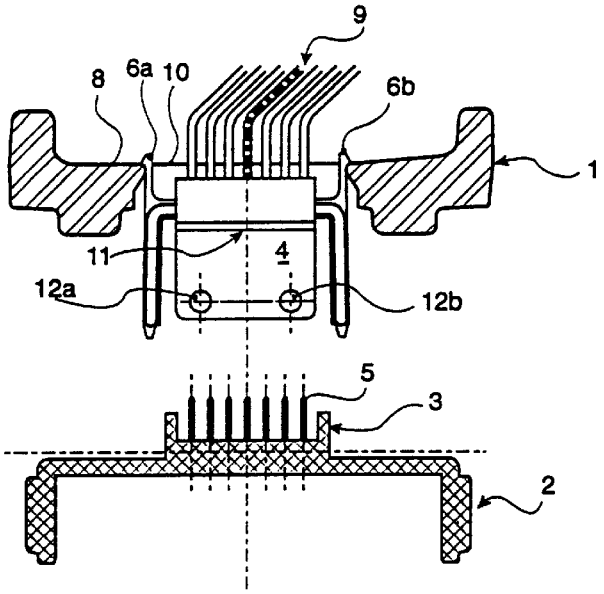
FIGS. 4*a* to 4*c* show diagrammatically an assembly operation of this type, the steering wheel and the top of the steering column being represented in simplified form, the electrical connecting plugs being viewed from another angle.
Figure 4B:
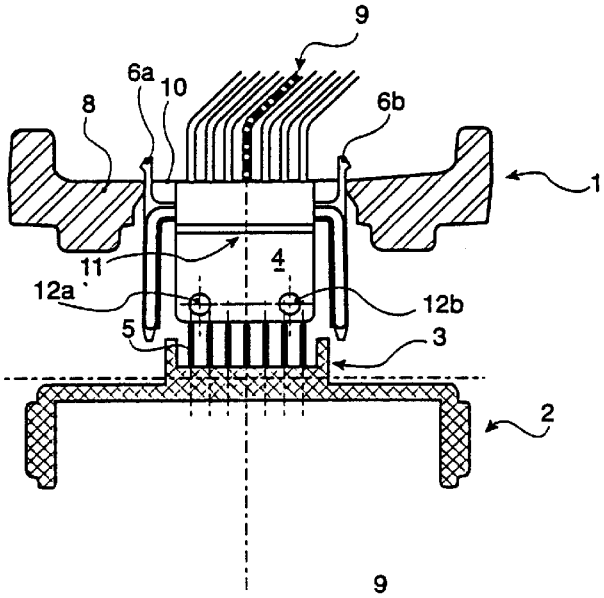
Figure 4C:
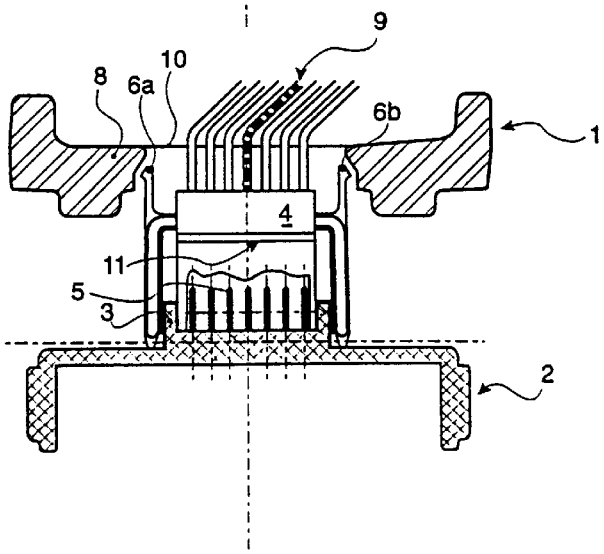

FIGS. 4*a* to 4*c* are further illustrations of the connection, as they are directed to longitudinally with respect to the parallelepiped box of the connector 4. Whereas in the preceding figures the action of the elastic components 7*a*, 7*b* (not shown in these figures) was evident, these make clear the action of the flexible lugs 6*a*, 6*b*.

In FIG. 4*a*, the cams fitted to the end of the lugs 6*a*, 6*b* rest on a surface of the wall 8, in the vicinity of the orifice 10. When the mechanical connection is started (FIG. 4*b*), the elastic components are constrained under pressure and the said cams rise and separate from the wall 8. This is also apparent in FIG. 2, where the components 7*a*, 7*b* can be seen compressed and the top of the box raised. This constraint is functionally important, because it assists in the axial guiding of the plug 4 into the plug 3.

In FIG. 4*c*, the said cams have enabled the plug 4 to be freed and consequently are situated under the wall 8. The electrical junction has been completely achieved, the assembly being itself locked.

As will be apparent in FIG. 5, the plug is that of a locking electrical connector known per se, the locking being achieved by a transverse stirrup 13 sliding in the box 3, operating in the following manner: the stirrup 13 is provided on its large longitudinal faces, with grooves 14*a*, 14*b* having a partially oblique appearance forming a cam-shaped path designed to cooperate with the studs 12*a*, 12*b* of the plug 4. Studs 12*a*, 12*b* are shown in particular in FIG. 6.

Figure 5:
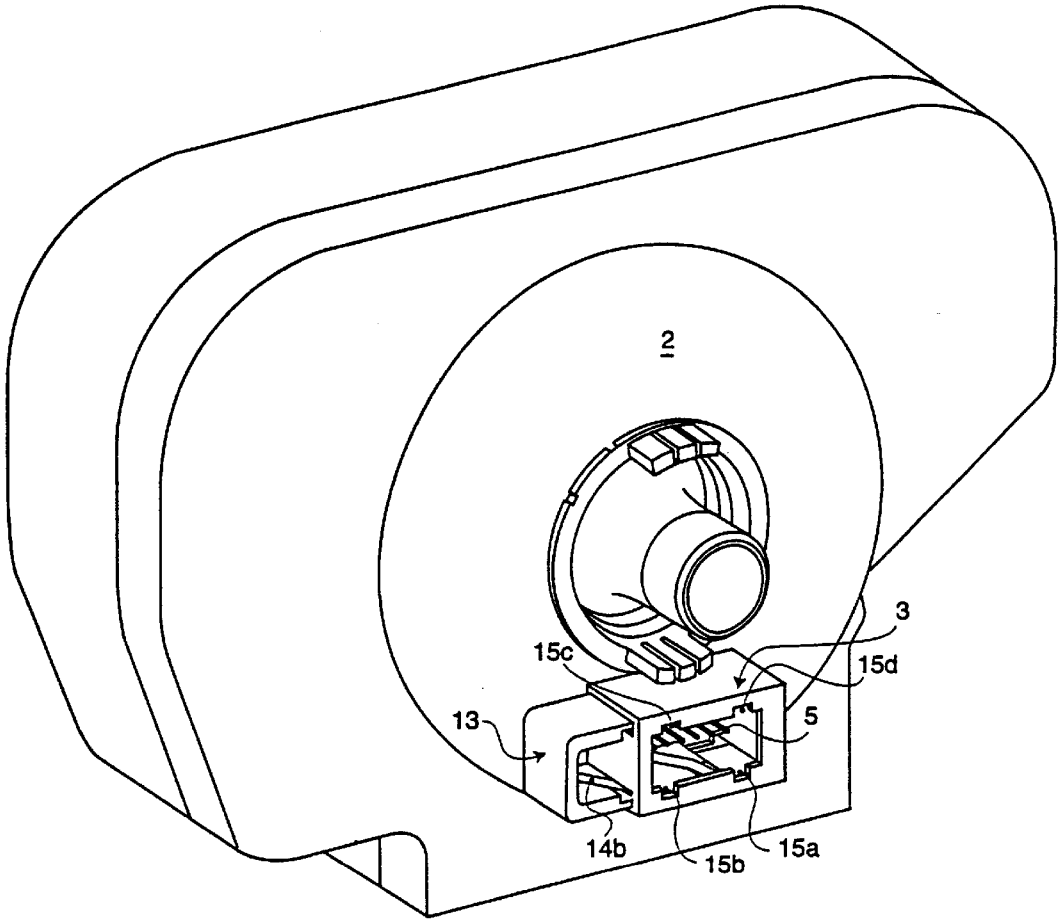
FIG. 5 is a perspective view of the top of a steering column provided with an electrical connecting plug.
Figure 6:
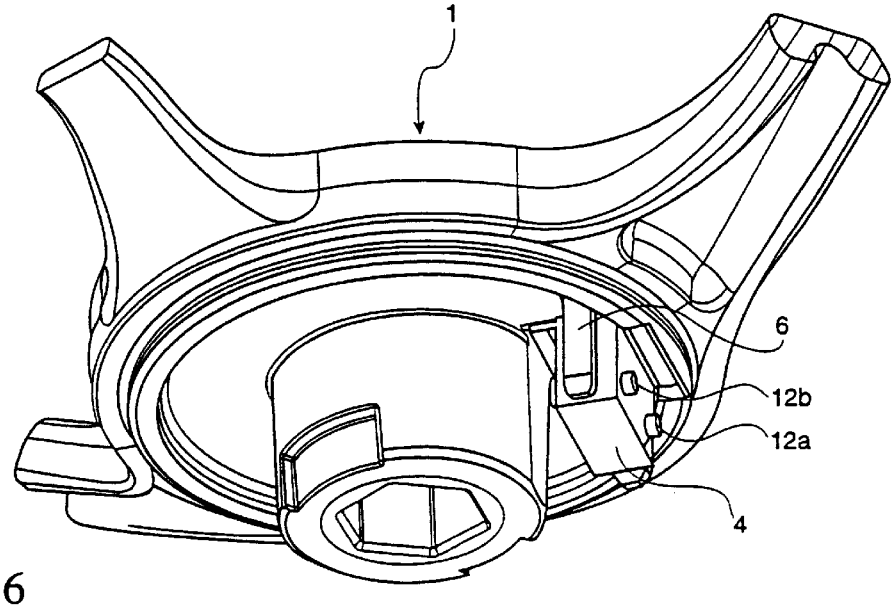
FIG. 6 is a perspective view of a steering wheel hub provided with a plug of the opposite type.

In the unlocked rest position, the stirrup 13 is deployed outwards as in FIG. 5, and the tracks 14*a*, 14*b*, including a portion close to the mouth substantially parallel to the axis of connection and placed facing notches 15*a*, 15*b*, 15*c*, 15*d*, are in a position to receive the studs 12*a*, 12*b* of the plug 4.

Taking into account the oblique appearance of the following portion of the grooves 14*a*, 14*b*, the studs however come up against a stop at the end of the axial portion. At this stage, coupling is initiated, the elastic components are under pressure (FIGS. 2 and 4*b*) and the steering wheel 1 is coupled to the top of the steering column 2.

When the stirrup is subjected to a pressure aimed at making it slide into the plug 3, the walls of the grooves that are visible 14*a*, 14*b*, as well as those which are on the opposite face, exert an action on the studs 12 which cause it to move in the grooves 14 as far as their ends situated at the bottom, i.e., opposite the mouth of the plug 3 so that the plug 4 is drawn towards the bottom of the plug 3 and is disconnected from the steering wheel.

Electrical connection is then entirely complete, as well as mechanical coupling, which is moreover locked.

Figure 7:
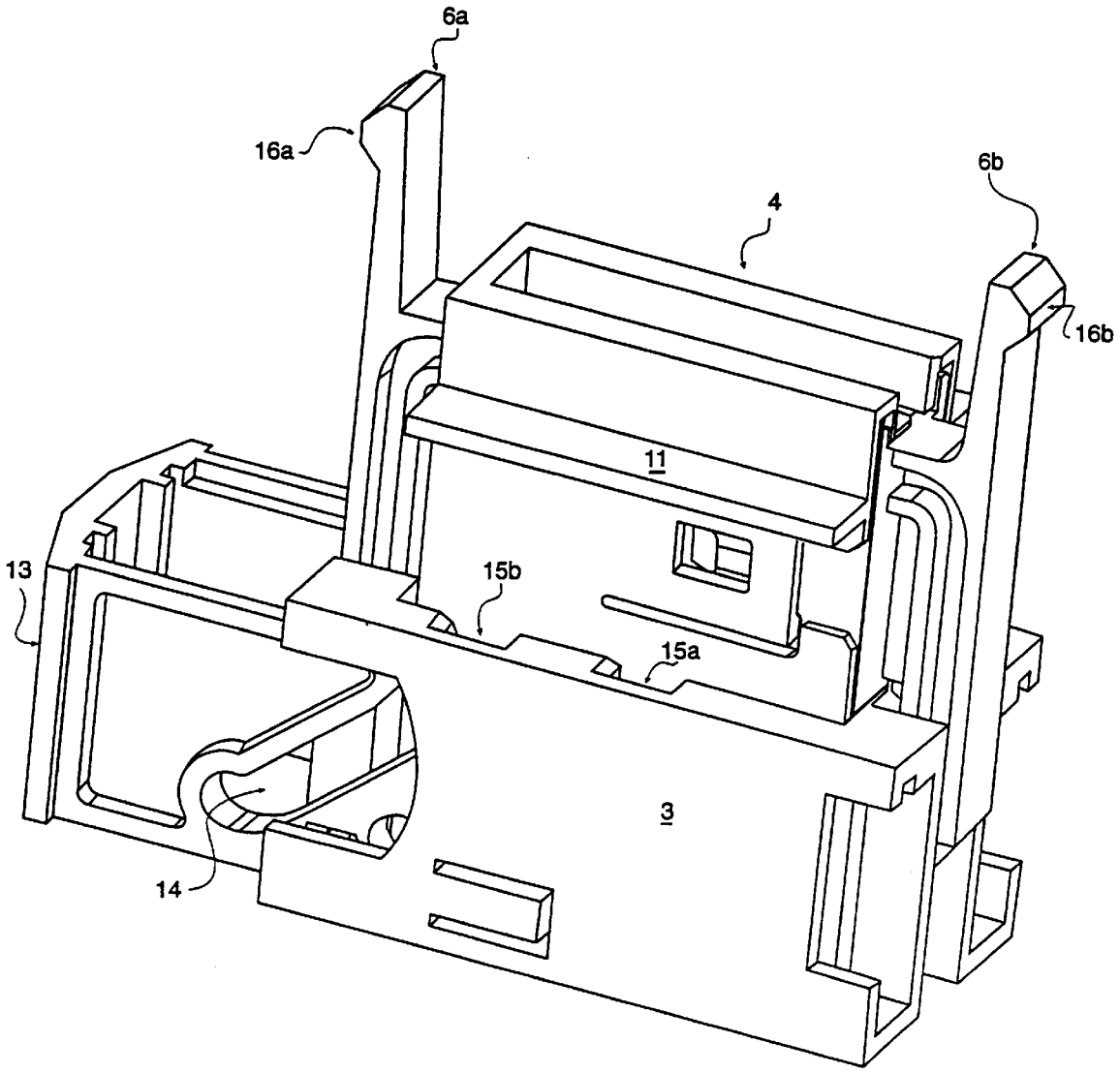
FIG. 7 shows, in perspective, a suitable complete connector within the scope of the invention.

FIG. 7 shows a locking electrical connector provided with its stirrup 13, in the initial preguiding position, i.e., when the plug 4 is partially inserted in the plug 3. This figure moreover shows the cams 16*a*, 16*b* situated at the end of each flexible lug 6*a*, 6*b* in the form of a V with a plane base. The elastic components 7*a*, 7*b* are not shown in FIG. 7, with only the supporting horizontal wing 11 being illustrated.

Figure 8A:
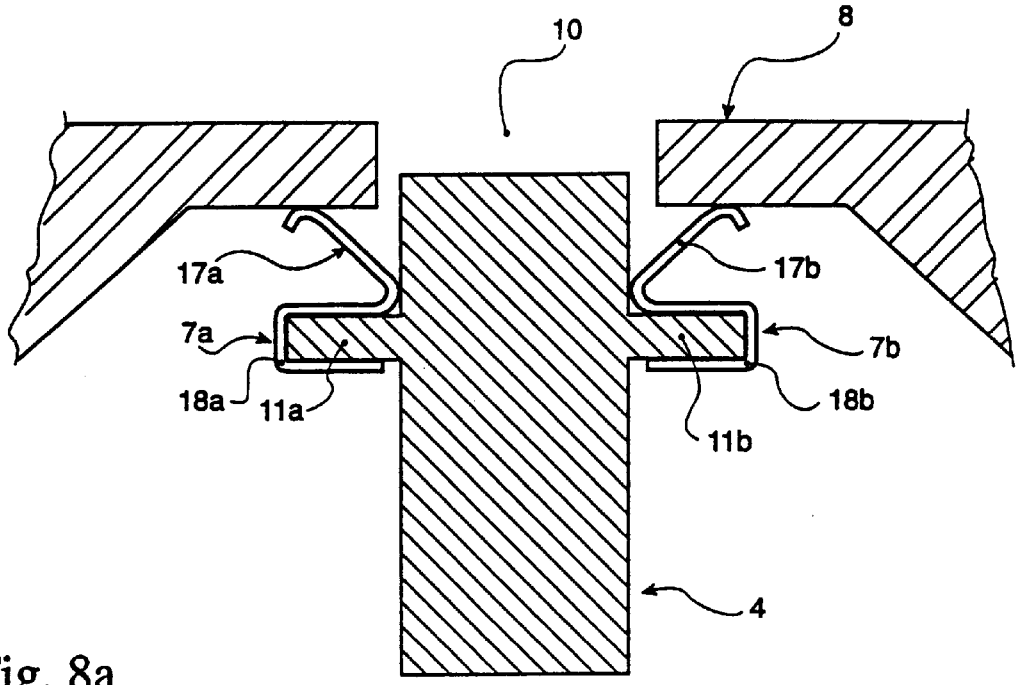
FIGS. 8*a* to 10*b* show possible variants of metal blades acting as elastic return components.

Referring to FIG. 8*a*, a diagrammatic cross section shows the connector 4 as well as the wall 8 and the orifice 10 of the steering wheel 1. Thus, in FIG. 8*a*, the cross section of the elastic component is in the shape of a deformed S, the upper part 17*a*, 17*b* mainly acting as a spring, having the form of a leaf spring.

Figure 8B:
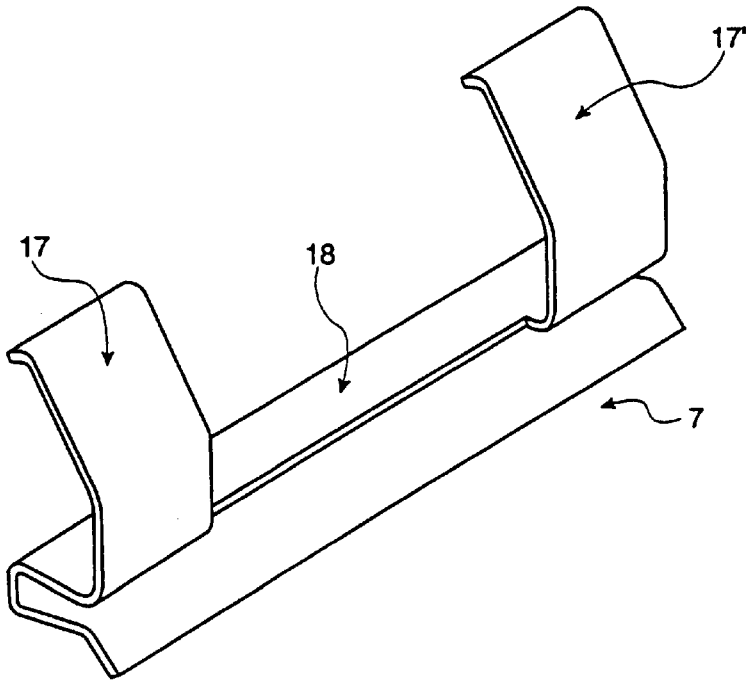

FIG. 8*b* shows that the lower part 18 matches the shape of the wing 11 and has an upper part 17, 17' only at its two ends. In the assembly of the plug 4 there is thus the equivalent of 4 leaf springs.

Figure 9A:
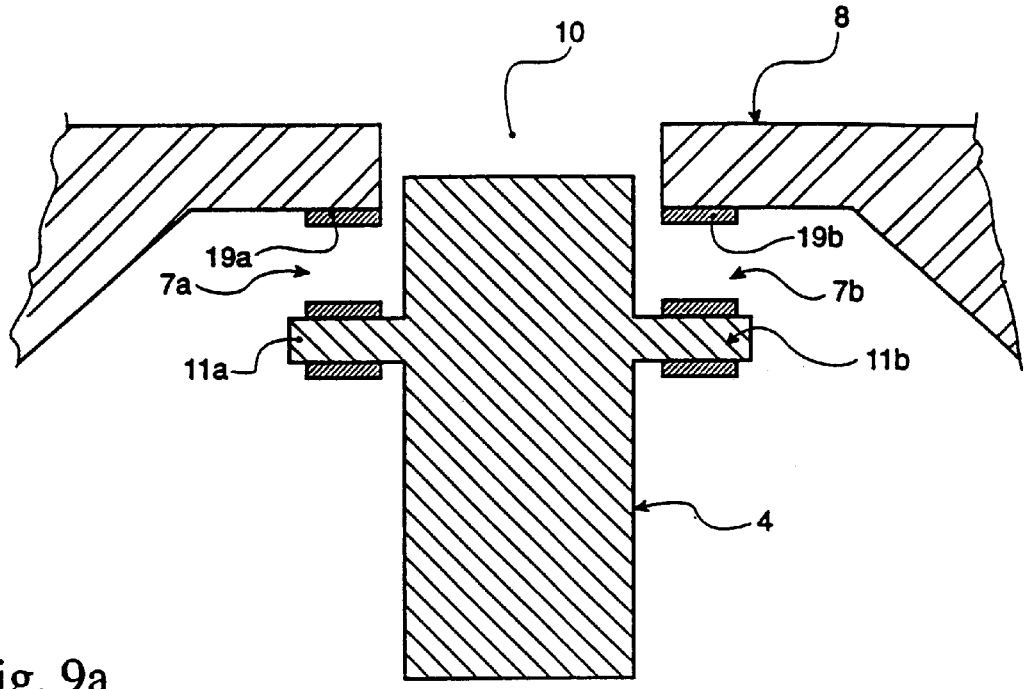
Figure 9B:
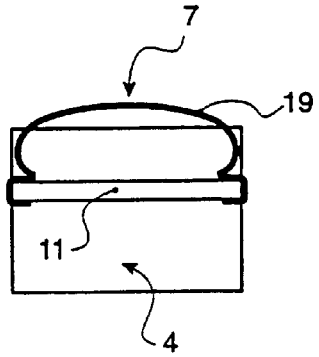
Figure 10A:
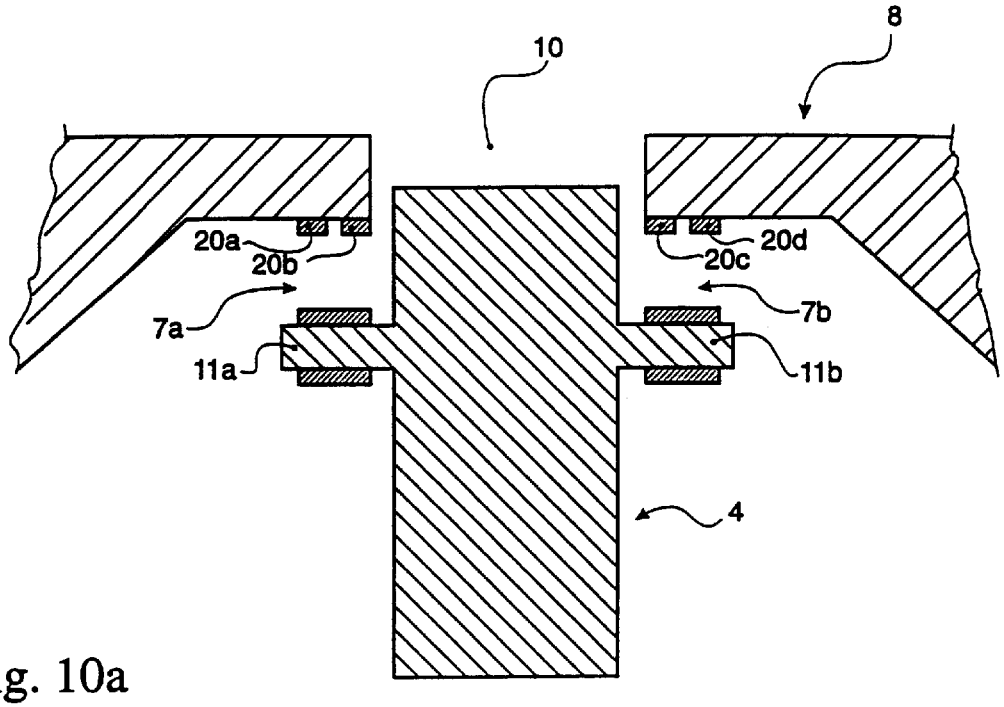
Figure 10B:
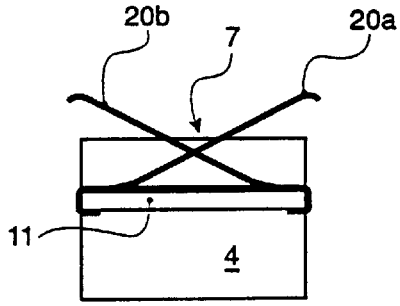

FIGS. 9*a* and 9*b* show a variant in which attachment to the wings 11 is made at the longitudinal ends; and, the wings are connected by an upper loop 19 exerting a more linear action on the wall 8. A metal blade is again used, as well as in the variant of FIGS. 10*a* and 10*b*, having at each side a double crossed blade 20*a*, 20*b*, 20*c*, 20*d*.

In this case, the action is once again more localized, applied to the four corners of the box of the plug 4, similar to the variant of FIGS. 8*a* and 8*b*.

Figure 11:
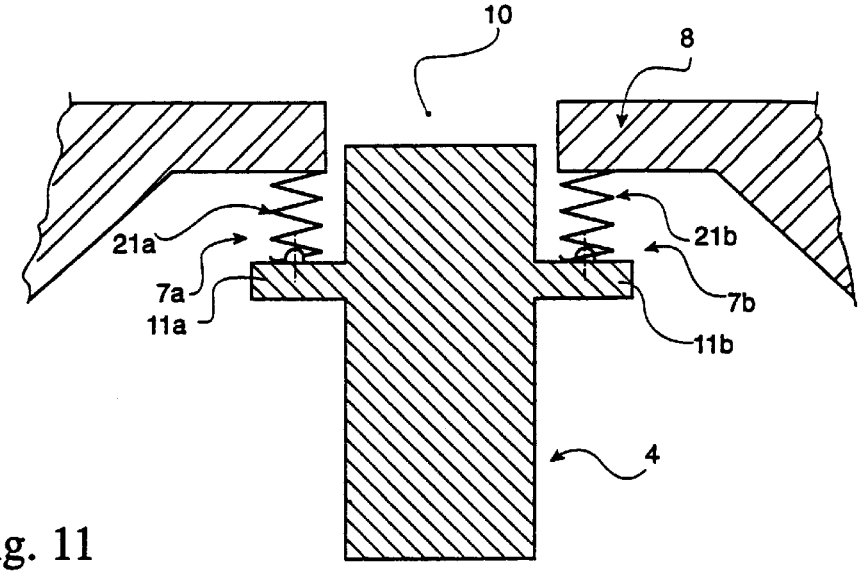
FIG. 11 is a variant with coil springs.

FIG. 11 shows a configuration provided with coil springs 21*a*, 21*b*, two or three in number per large face of the plug 4.

Figure 12:
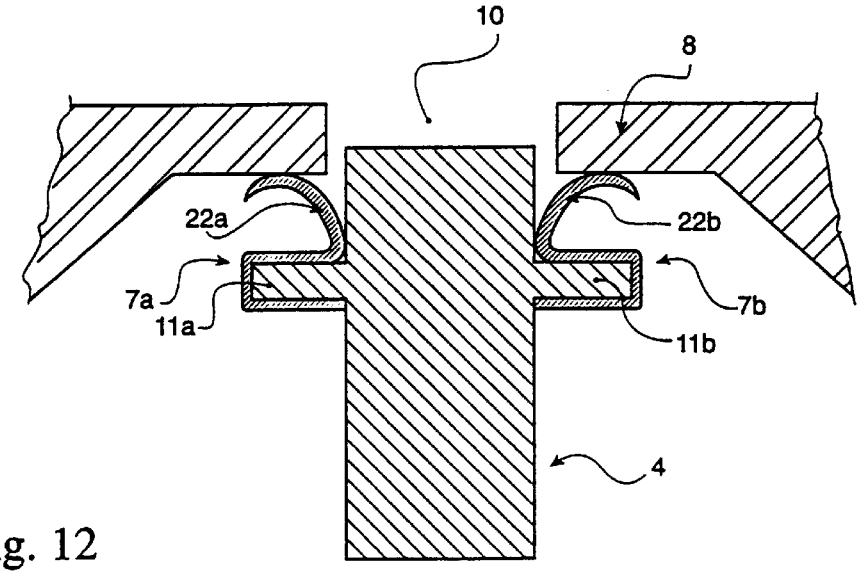
FIGS. 12 and 13 show alternative embodiments using return components made of elastic foam.

FIG. 12 shows an elastic component 7*a*, 7*b* made of a synthetic material, of an extremely resilient foam type. In section, this component 22*a*, 22*b* is similar to that shown in FIGS. 8*a* and 8*b*, the difference, other than the material, residing in the continuity of the top part.

Figure 13:
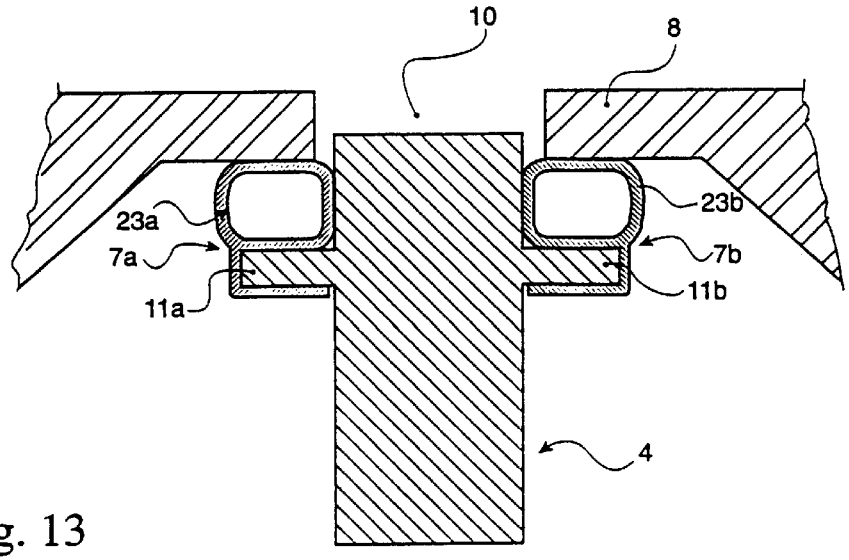

In FIG. 13, the elastic component 7*a*, 7*b*, also made of synthetic material, comprises a hollow upper cushion 23*a*, 23*b* exerting a return action simultaneously on the wings 11*a*, 11*b* and on the wall 8, the actions being equal and opposite. The upper cushion may, alternatively, be replaced by a solid pad of which the face opposite the wings 11*a*, 11*b* is self adhesive and lacking a lower part.

The overall operation is as follows:

When the steering wheel 1 is mechanically assembled to the top of the steering column 2, the position is arrived at as shown in FIGS. 2 and 4*b*, and similar to that illustrated in FIGS. 8*a* to 13. The return components are constrained and mechanical guiding of one plug of the connector is commenced with respect to the other.

The operator then proceeds to carry out a locking operating by forcing in the stirrup 13 which has the effect of pulling the connector 4 and detaching the steering wheel 1. It is thus no longer subject to any mechanical stress, the wiring 9 being long enough to absorb any stresses exerted thereon.

Removal of the steering wheel is preceded by an inverse manipulation of the stirrup 13, which has the effect of pushing the connector 4 towards the steering wheel sufficiently to enable axial clipping to be carried out. The steering wheel 1 and the plug 4 are once again fixed together, the end of the plug being however still inserted in the plug 3, but not locked. It is then sufficient to remove the steering wheel 1 from the top of the steering column in order to disengage the ends.

In one direction or the other, these operations are extremely simple and are rapidly carried out.

Although the invention has hereinabove been described with respect to the illustrated embodiments, it will be understood that the invention is capable of modification and variation and is limited only by the following claims.

We claim:

1. A system for connecting an electrical connector on a vehicle steering wheel to a mating stationary connector on the vehicle steering column surrounding the steering shaft comprising:

(a) a first electrical connector releasably mounted on said steering wheel with mounting portions thereof releasably engaging certain surfaces on said steering wheel, said first connector also having locking surfaces thereon;

(b) a second electrical connector mounted on the steering column and disposed for connecting to said first connector when said steering wheel is axially assembled onto said steering shaft;

(c) a locking member associated with said second connector and moveable with respect thereto between an open and a locking position, whereupon said axial assembly of said steering wheel on said steering shaft said first connector partially engages said second connector, and upon movement of said locking member to said locking position said locking member contacts said locking surfaces and effects movement of said first connector to the fully engaged position with said second connector whereupon said mounting portions of said first connector are released from engagement with said certain surfaces of said steering wheel.

2. The system defined in claim 1, wherein said first connector includes a spring biasing said mounting portions into engagement with said certain surfaces on said steering wheel.

3. The system defined in claim 1, wherein said mounting portion of said first connector include a pair of resilient tabs extending therefrom in spaced generally parallel arrangement.

4. The system defined in claim 1, wherein said engaging surface on said second connector includes a plurality of lugs extending therefrom.

5. The system defined in claim 1, wherein said locking member includes cam surfaces contacting said locking surfaces on said first connector.

6. The system defined in claim 1, wherein said locking member has a generally stirrup shaped configuration.

7. The system defined in claim 1, wherein said locking member is moveable at right angles to said steering shaft between said open and locking position.

8. A method of making an electrical connection on a stationary steering column with a rotatable steering shaft upon installation of a steering wheel on the shaft comprising:

(a) releasably attaching a first electrical connector on the steering wheel;

(b) disposing a second connector on the steering column and providing a moveable locking member on the second connector;

(c) axially assembling the steering wheel onto the steering shaft and axially engaging said first connector with said second connector to a position less than fully engaged;

(d) moving said locking member and contacting said first connector and moving said first connector to a position fully engaging said second connector and releasing said first connector from said steering wheel.

9. The method defined in claim 8, wherein said step of moving said locking member includes moving said member in a direction transverse to said steering shaft.

10. The method defined in claim 8, wherein said step of contacting and moving said first connector with said locking member includes camming.

* * * * *